United States Patent [19]

Nakamura et al.

[11] Patent Number: 4,550,709

[45] Date of Patent: Nov. 5, 1985

[54] CONSTRUCTION FOR PREVENTING OIL LEAKAGE IN OIL BURNER

[75] Inventors: Kazuharu Nakamura; Yoshimasa Tsuboi; Akinobu Kondo, all of Nagoya, Japan

[73] Assignee: Toyotomi Kogyo Co., Ltd., Aichi, Japan

[21] Appl. No.: 633,322

[22] Filed: Jul. 23, 1984

[30] Foreign Application Priority Data

Jul. 21, 1983 [JP] Japan ..... 58-113466[U]

[51] Int. Cl.[4] ..... F24C 5/04

[52] U.S. Cl. ..... 126/96

[58] Field of Search ..... 126/96, 45, 49; 431/344

[56] References Cited

U.S. PATENT DOCUMENTS 2,189,871 2/1940 Thomas ..... 126/96

*Primary Examiner*—Carroll B. Dority, Jr.

*Attorney, Agent, or Firm*—Pollock, Vande Sande & Priddy

[57] ABSTRACT

A construction for preventing oil leakage in an oil burner is disclosed which is capable of effectively preventing oil leakage from an oil burner, particularly, a means for supporting a cartridge-type oil tank on an auxiliary tank when the burner falls down in any direction. The construction includes an oil reservoir mounted through the oil tank supporting means in the auxiliary tank and provided with a through-hole at the side portion thereof facing a combustion mechanism of the burner only through the oil tank is communicated with the auxiliary tank. The auxiliary tank has a volume determined to allow an oil level in the auxiliary tank to be constantly lower than the through-hole of the oil reservoir even when the oil burner falls down in any direction to prevent oil leakage from the oil tank supporting means.

6 Claims, 4 Drawing Figures

CONSTRUCTION FOR PREVENTING OIL LEAKAGE IN OIL BURNER

BACKGROUND OF THE INVENTION

1. Field of the Invention

This invention relates to a construction for preventing oil leakage in an oil burner, and more particularly to such a construction in an oil burner having a cartridge-type oil tank which is adapted to effectively prevent oil leakage from the oil burner at the time when the oil burner falls down.

2. Description of the Prior Art

An oil burner having a cartridge-type oil tank disposed thereon is generally formed into a rectangular shape in which the width is larger than the depth. Accordingly, the oil burner generally tends to fall down in the forward or rearward direction, for example, when the earthquake occurs. Also, it is often experienced that the oil burner falls down in the lateral direction. However, a counterplan has not been unfortunately considered for effectively preventing oil leakage from the oil burner, particularly, a means for supporting a cartridge-type oil tank in an inverted manner on a burner body, at the lateral falling as well as the forward or rearward direction.

More particularly, in an oil burner of such type, a cartridge-type oil tank is closed with a valve-operated cap to prevent oil leakage therefrom and an auxiliary tank is generally formed into a laterally elongated rectangular shape of small height and depth so that a small amount of fuel oil is received therein, to thereby substantially prevent oil leakage therefrom. Also, a wick receiving chamber is of a sealed construction by means of a packing material to prevent oil leakage therefrom. However, the prevention of oil leakage from the connection between the auxiliary tank and an oil tank supporting means has not been substantially carried out.

Accordingly, it would be highly desirable to develop a construction for preventing oil leakage in an oil burner which is capable of effectively preventing oil leakage from the oil burner at the falling in the lateral direction as well as that in the forward or rearward direction.

SUMMARY OF THE INVENTION

The present invention has been made in view of the foregoing disadvantage of the prior art.

Accordingly, it is an object of the present invention to provide a construction for preventing oil leakage in an oil burner which is capable of effectively preventing oil leakage at the falling of the oil burner in the lateral direction as well as that in the forward or rearward direction.

It is another object of the present invention to provide a construction for preventing oil leakage in an oil burner which is capable of effectively preventing oil leakage from the connection between an auxiliary tank and an oil tank supporting means at the falling of the oil burner in the lateral direction as well as that in the forward or rearward direction. It is a further object of the present invention to provide a construction for preventing oil leakage in an oil burner which is capable of effectively preventing oil leakage from the oil burner at the falling with a simple construction.

In accordance with the present invention, there is provided a construction for preventing oil leakage in an oil burner of the type that a cartridge-type oil tank having a valve-operated cap is invertedly supported on an auxiliary tank provided in said oil burner through an oil tank supporting means provided at the upper wall of said auxiliary tank and fuel oil is fed from said oil tank through said auxiliary tank to a combustion mechanism of said oil burner, comprising an oil reservoir mounted through said oil tank receiving means of said auxiliary tank to said auxiliary tank to surround said valve-operated cap of said oil tank, said oil reservoir being formed at the side portion thereof facing said combustion mechanism of said oil burner with a through-hole; said auxiliary tank having a volume determined to allow an oil level in said auxiliary tank obtained when said oil burner falls down in the forward or rearward direction to be substantially lower than said through-hole of said oil reservoir and allow an oil level in said auxiliary tank obtained when said oil burner falls down in the lateral direction to be substantially lower than said through-hole of said oil reservoir, so that said through-hole of said oil reservoir may be constantly above the oil level when said oil burner falls down in any direction; said oil tank supporting means being oil-sealedly mounted with respect to said auxiliary tank.

In accordance with the present invention, there is also provided a construction for preventing oil leakage in an oil burner of the type that a cartridge-type oil tank having a valve-operated cap is invertedly supported on an auxiliary tank provided to laterally extend from a combustion mechanism of said oil burner through an oil tank supporting means provided near the end portion of the upper wall of said auxiliary tank and fuel oil is fed from said oil tank through said auxiliary tank to said combustion mechanism of said oil burner, comprising an oil reservoir oil-sealedly mounted through said oil tank receiving means to said auxiliary tank to downward extend from said oil tank receiving means in said auxiliary tank and surround said valve-operated cap, said oil reservoir being formed at the side portion thereof facing said combustion mechanism of said oil burner with a through-hole which permits said auxiliary tank to be communicated only therethrough with said oil tank; said oil tank supporting means being oil-sealedly mounted with respect to said auxiliary tank; said auxiliary tank having a volume determined to allow an oil level in said auxiliary tank obtained when said oil burner falls down in the forward or rearward direction to be substantially lower than said through-hole of said oil reservoir; said auxiliary tank having a first chamber formed at the outside of said oil reservoir which has a volume sufficient to substantially receive therein fuel oil in said auxiliary tank to allow an oil level in said auxiliary tank to be substantially lower than said through-hole of said oil reservoir when said oil burner falls down on the oil tank side.

BRIEF DESCRIPTION OF THE DRAWINGS

Other objects and many of the attendant advantages of the present invention will be readily appreciated as the same becomes better understood by reference to the following description when considered in connection with the accompanying drawings in which like reference numerals designate the same parts throughout; wherein.

DETAILED DESCRIPTION OF THE PREFERRED EMBODIMENT

Now, a construction for preventing oil leakage in an oil burner according to the present invention will be described with reference to the accompanying drawings.

Figure 1:
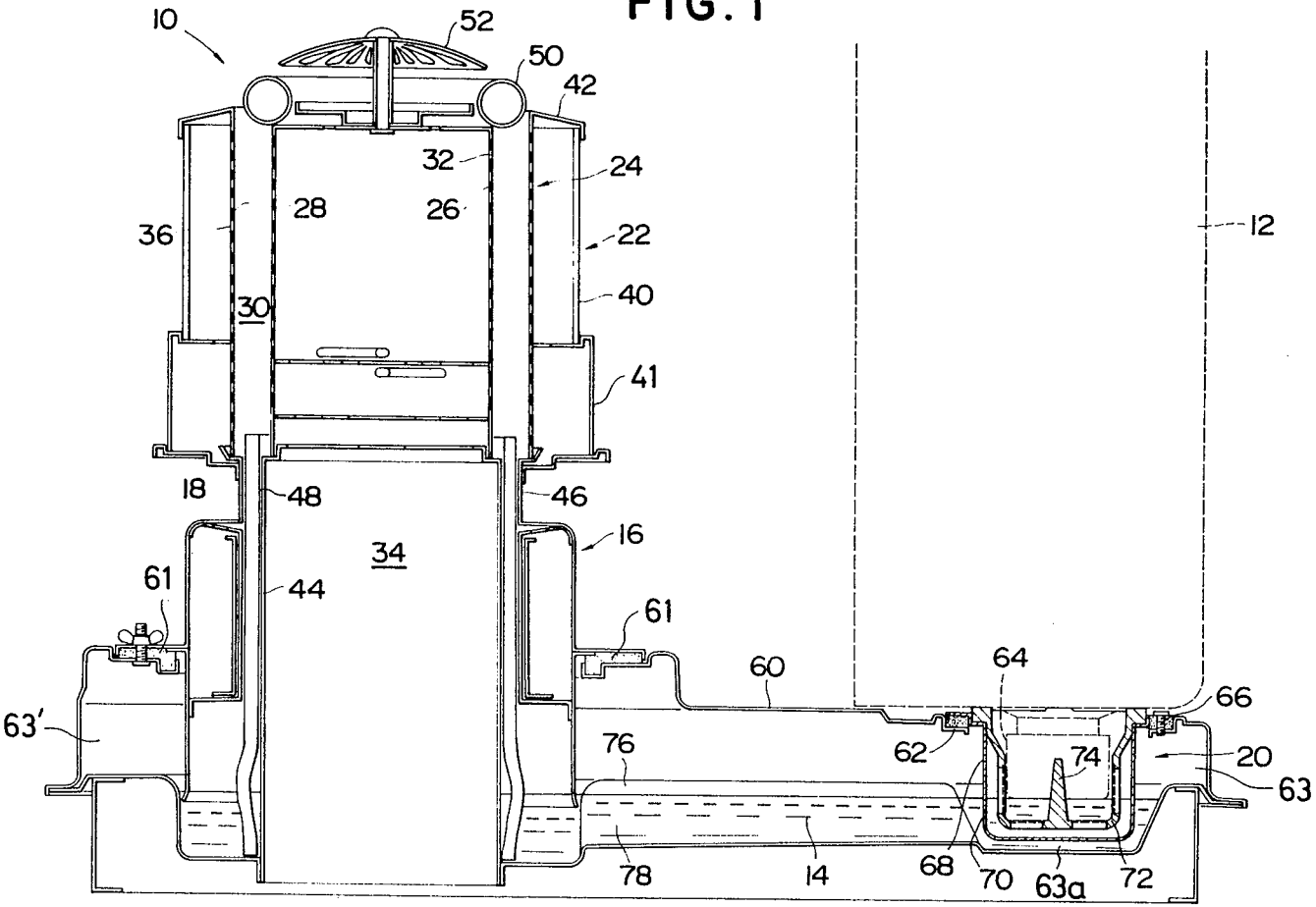
FIG. 1 is a schematic vertical sectional view showing an example of an oil burner having an embodiment of a construction for preventing oil leakage according to the present invention incorporated therein.
Figure 2:
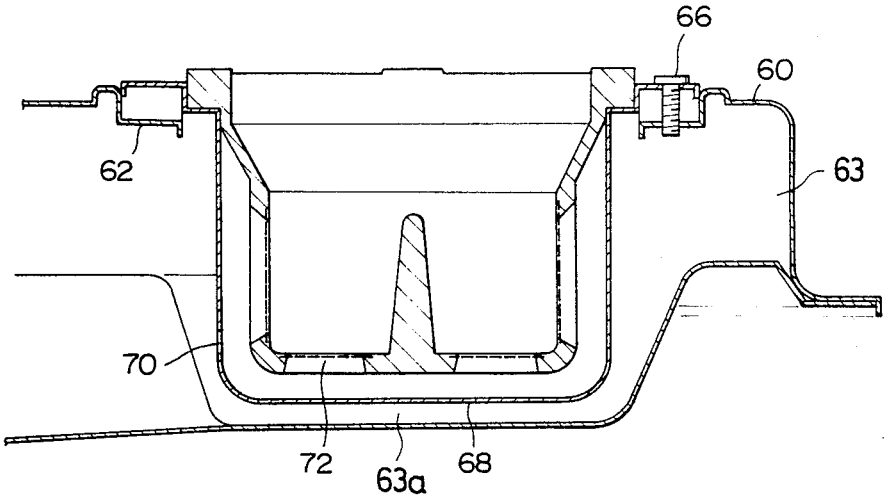
FIG. 2 is an enlarged sectional view showing the essential part of the construction for preventing oil leakage shown in FIG. 1.

FIG. 1 illustrates an example of an oil burner in which a construction for preventing oil leakage according to the present invention is adapted to be incorporated. The oil burner illustrated in FIG. 1 is generally designated by reference numeral 10 and in the form of a wick-ignition type red-heated oil burner, however, it should be noted that an oil burner in which a construction for preventing oil leakage according to the present invention is adapted to be employed is not limited to such an oil burner.

Prior to describing a construction for preventing oil leakage in an oil burner according to the present invention, the oil burner 10 illustrated in FIG. 1 will be briefly described.

The oil burner per se is constructed in a manner conventionally known to those skilled in the art. The oil burner 10 includes a cartridge-type oil tank 12 for storing therein fuel oil 14 such as kerosine, a wick receiving cylinder 16 which receives a wick 18 therein and communicates with the oil tank 12 through a construction for preventing oil leakage 20 according to the present invention hereinafter described in detail, and a combustion cylinder construction 22 placed on the wick receiving cylinder 18. The wick receiving cylinder 18 is oil-sealedly formed to prevent oil from leaking from the cylinder to the outside.

The combustion cylinder construction 22 includes a double combustion cylinder 24 comprising an inner cylindrical member 26 and an outer cylindrical member 28 arranged to be concentrical with the inner cylindrical member 26 with a space 30 of a suitable interval being defined therebetween. The inner cylindrical member 26 is formed with a plurality of through-holes 32 which serve to introduce a part of combustion air to the space 30 from an internal cylindrical space 34 defined in the burner and communicated through the bottom of a burner body with the exterior of the burner. The outer cylindrical member 28 is also formed with a plurality of through-holes 36. Also, the combustion cylinder construction 22 includes a heat-permeable cylinder 40 which is formed of, for example, a heat resistant glass and supported through a non-permeable cylinder 41 on the wick receiving cylinder 16. The heat-permeable cylinder 40 is arranged to surround the double combustion cylinder 24 with a space of a suitable interval being defined therebetween and serves to discharge heat rays emitted from the inner and outer combustion cylinders red-heated due to combustion carried out in the space and probably at the outside of the outer cylindrical member 28 therethrough to the exterior of the burner 10. The space between the heat-permeable cylinder 40 and the outer cylindrical member 28 is closed at the upper end thereof with a top plate 42 of the outer cylindrical member 28.

The wick receiving cylinder 16 has an inner wall 44 and an outer wall 46 which are arranged to define therebetween an annular wick receiving chamber 48 communicated with the space 30 between the inner and outer cylindrical members 26 and 28 of the double combustion cylinder 24. When combustion is to be carried out, the wick, as shown in FIG. 1, is raised to the lower portion of the space 30 by means of a wick actuating mechanism (not shown).

Reference numeral 50 designates a coil formed of metal, which is red-heated due to combustion heat generated from the space 30 between the cylindrical members 26 and 28 during the combustion operation, and reference numeral 52 designates a top plate arranged above the internal space 34.

The construction for preventing oil leakage of the illustrated embodiment includes a shallow auxiliary tank 60 communicated with the wick receiving chamber 48 which is formed into a substantially rectangular shape and arranged to surround the lower half of the wick receiving cylinder 16. More particularly, the auxiliary tank 60 is formed into a laterally elongated shape or laterally extends from one side of the wick receiving cylinder 16. The auxiliary tank 60 is oil-sealedly mounted with respect to the wick receiving cylinder 16 by means of an oil-sealing fixture 61 to prevent oil from leaking from the connection between the auxiliary tank 60 and the wick receiving cylinder 16 to the outside. The auxiliary tank 60 is formed at the upper wall thereof near the outward extending end thereof with an oil tank supporting means 62 which serves to support the cartridge-type oil tank 12 in an inverted manner.

Figure 3:
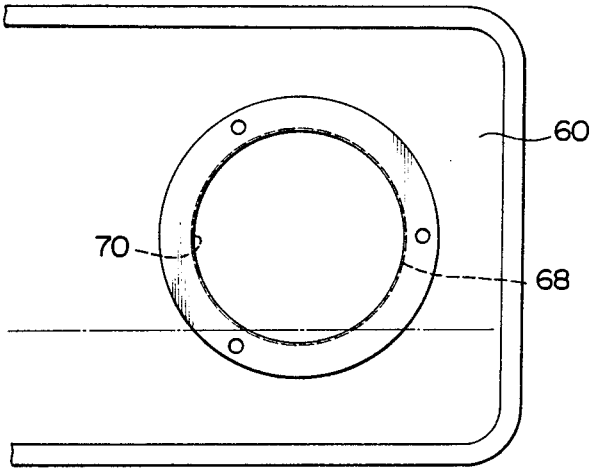
FIG. 3 is a schematic view showing an oil level in an auxiliary oil tank obtained when the oil burner shown in FIG. 1 falls down in the forward direction.

The oil tank supporting means 62 is provided at the substantially middle position along the transverse direction of the auxiliary tank 60. The auxiliary tank 60 is formed to have a volume which allows an oil level in the auxiliary tank obtained when the oil burner falls down in the forward or rearward direction to be substantially lower than the middle portion of the oil tank supporting means 62 or reach at most the lower portion of the means 62, as shown in FIG. 3. The oil leakage preventing construction of the present invention is also adapted to allow an oil level in the auxiliary tank obtained when the oil burner falls down on the oil tank side or the right side in FIG. 1 to be substantially lower than the upper portion of the oil tank supporting means 62 or reach at most the middle portion of the oil means 62. In the illustrated embodiment, this is accomplished by the cooperation of a chamber 63 formed at the outside of the oil tank supporting means 62 and a bottom recess **63*a* formed at the portion of the auxiliary tank in which an oil reservoir described hereinafter is received. However, this may be carried out by only the chamber 63. The auxiliary tank 60 in the illustrated embodiment is also provided at the outside of the wick receiving cylinder 16 with another chamber 63' which serves to substantially receive therein fuel oil in the auxiliary tank 60 when the oil burner falls down on the left side in FIG. 1**.

The oil tank is closed at the inlet thereof with a valve-operated cap 64. The oil tank supporting means 62 is oil-sealedly fixed on the auxiliary tank by means of an oil-sealing fixture 66 to prevent oil leakage therefrom. Reference numeral 68 designates an oil reservoir provided to surround the cap 64 of the cartridge-type oil tank 12, which is oil-sealedly mounted with respect to the auxiliary tank 60 in a manner to downward extend from the upper surface of the auxiliary tank and be received at the lower portion in the recess 63*a*. In the illustrated embodiment, the oil reservoir 68 is mounted through the oil tank supporting means 62 with respect to the auxiliary tank 60. The oil reservoir 68 has a through-hole 70 formed at the side portion thereof facing the wick receiving cylinder only through which the interior of the oil reservoir 68 is communicated with the auxiliary tank 60. The through-hole 70, as shown in FIG. 1, is formed at the height of the oil reservoir 68 constantly hidden by fuel oil in the auxiliary tank 60.

Figure 4:
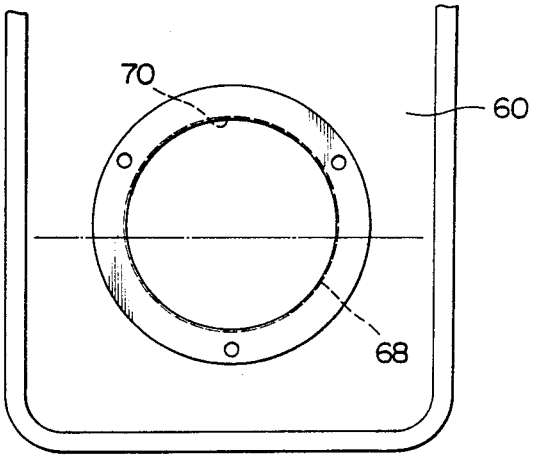
FIG. 4 is a schematic view showing an oil level in an auxiliary oil tank obtained when the oil burner shown in FIG. 1 falls down on the right side in FIG. 1.

Thus, it will be noted that the through-hole 70, when the oil burner 10 falls down in any direction, is constantly at a position higher than an oil level in the auxiliary tank 60, as shown in FIGS. 3 and 4. More particularly, when the oil burner falls down in the forward or rearward direction, the through-hole 70 looks just aside as shown in FIG. 3; thus, the through-hole is never hidden by fuel oil in the auxiliary tank 60 because the oil level is substantially lower than the middle portion of the oil tank supporting means 62 or the through-hole 70, so that fuel oil may be prevented from leaking through the through-hole 70 to the exterior of the oil tank supporting means 62. When the oil tank falls down on the right side in FIG. 1, the oil level is substantially lower than the upper portion of the oil tank supporting means 62 or the through-hole 70 as shown in FIG. 4, to thereby prevent oil leakage through the through-hole. Furthermore, when the oil burner falls down on the left side, the fuel oil is substantially received in the chamber 63'.

The oil reservoir 68 is provided therein with a filter means 72, which is interposed between the oil reservoir and the cap 64 of the oil tank 12 to filter fuel oil supplied from the oil tank 12 to the oil reservoir 68. The filter means 72 is formed with a pin member 74 upward projecting from the central portion of the lower wall thereof, which serves to open a valve (not shown) of the cap 64 of the oil tank 12 against a downward resilient force of the valve to communicate the oil tank 12 with the oil reservoir 68, when the oil tank 12 is invertedly placed on the oil tank supporting means 62.

Reference numeral 76 designates a pair of protrusions laterally extending from the oil reservoir 68 to the wick receiving cylinder 16 in parallel with each other with a trough 78 of a suitable width being defined therebetween which acts to guide fuel oil from the oil reservoir 68 to the wick receiving cylinder 16. The protrusions 76 also serves to keep fuel oil in the auxiliary tank 60 at a predetermined volume or limit the volume of the auxiliary tank 60 to prevent excessive fuel oil from being received in the auxiliary tank.

As described above, the oil leakage construction of the illustrated embodiment can prevent oil leakage even when the oil burner falls in any direction. When the oil burner falls down in the forward or rearward direction, an oil level in the auxiliary tank 60 is at most at the lower portion of the oil tank supporting means 62 to allow the through-hole 70 of the oil reservoir 68 to be constantly above the oil level, so that the oil leakage may be effectively prevented. When the oil burner falls down in the oil tank side or on the right side in FIG. 1, fuel oil in the auxiliary tank is substantially received in the end chamber 63 to allow the through-hole 70 to be also above the oil level as shown in FIG. 4, resulting in the oil leakage being positively prevented.

As can be seen from the foregoing, the present invention can effectively prevent oil leakage through the oil tank supporting means when the oil burner falls in the lateral direction as well as the forward or rearward direction.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A construction for preventing oil leakage in an oil burner of the type that a cartridge-type oil tank having a valve-operated cap is invertedly supported on an auxiliary tank provided in said oil burner through an oil tank supporting means provided at the upper wall of said auxiliary tank and fuel oil is fed from said oil tank through said auxiliary tank to a combustion mechanism of said oil burner, comprising:

an oil reservoir mounted through said oil tank supporting means of said auxiliary tank to said auxiliary tank to surround said valve-operated cap of said oil tank; said oil reservoir being formed at the side portion thereof facing said combustion mechanism of said oil burner with a through-hole;

said auxiliary tank having a volume determined to allow an oil level in said auxiliary tank obtained when said oil burner falls down in the forward or rearward direction to be substantially lower than said through-hole of said oil reservoir and allow an oil level in said auxiliary tank obtained when said oil burner falls down in the lateral direction to be substantially lower than said through-hole of said oil reservoir, so that said through-hole of said oil reservoir may be constantly above the oil level when said oil burner falls in any direction;

said oil tank supporting means being oil-sealedly mounted with respect to said auxiliary tank.

2. A construction for preventing oil leakage in an oil burner as defined in claim 1, wherein said oil reservoir is oil-sealedly mounted with respect to said oil tank supporting means.

3. A construction for preventing oil leakage in an oil burner as defined in claim 1, wherein said auxiliary tank has a first chamber provided at one side end thereof adjacent to said oil reservoir which has a volume sufficient to receive therein fuel oil in said auxiliary tank to allow an oil level in said auxiliary tank to be substantially lower than said through-hole of said oil reservoir when said oil burner falls down on the oil tank side.

4. A construction for preventing oil leakage in an oil burner as defined in claim 3, wherein said auxiliary tank has a second chamber provided at the other side end thereof opposite to said one side end, said second chamber having a volume sufficient to substantially receive therein fuel oil in said auxiliary tank when said oil burner falls down on said combustion mechanism side.

5. A construction for preventing oil leakage in an oil burner as defined in claim 3, wherein said auxiliary tank has a recess formed at the bottom portion thereof which has a space sufficient to receive therein said lower portion of said oil reservoir, said recess being adapted to receive therein fuel oil in said auxiliary tank together with said first chamber to allow an oil level in said auxiliary tank obtained when said oil burner falls down on the oil tank side to be substantially lower than said through-hole of said oil reservoir.

6. A construction for preventing oil leakage in an oil burner of the type that a cartridge-type oil tank having a valve-operated cap is invertedly supported on an auxiliary tank provided to laterally extend from a combustion mechanism of said oil burner through an oil tank supporting means provided near the end portion of the upper wall of said auxiliary tank and fuel oil is fed from said oil tank through said auxiliary tank to said combustion mechanism of said oil burner, comprising:

an oil reservoir oil-sealedly mounted through said oil tank supporting means to said auxiliary tank to downward extend from said oil tank supporting means in said auxiliary tank and surround said valve-operated cap, said oil reservoir being formed at the side portion thereof facing said combustion mechanism of said oil burner with a through-hole which permits said auxiliary tank to be communicated only therethrough with said oil tank;

said oil tank supporting means being oil-sealedly mounted with respect to said auxiliary tank;

said auxiliary tank having a volume determined to allow an oil level in said auxiliary tank obtained when said oil burner falls down in the forward or rearward direction to be substantially lower than said through-hole of said oil reservoir;

said auxiliary tank having a first chamber formed at the outside of said oil reservoir which has a volume sufficient to substantially receive therein fuel oil in said auxiliary tank to allow an oil level in said auxiliary tank to be substantially lower than said through-hole of said oil reservoir when said oil burner falls down on the oil tank side.

* * * * *